US007121041B2

(12) United States Patent
Anderson et al.

(10) Patent No.: US 7,121,041 B2
(45) Date of Patent: Oct. 17, 2006

(54) SECURITY BARRIER REINFORCING SYSTEM

(75) Inventors: Joe W. Anderson, Knoxville, TN (US); Michael W. Light, Knoxville, TN (US); Victor J. Kaminsky, Knoxville, TN (US); James Powers, Oak Ridge, TN (US); Richard W. Schenk, Rockford, TN (US)

(73) Assignee: Performance Development Corporation, Oak Ridge, TN (US)

( * ) Notice: Subject to any disclaimer, the term of this patent is extended or adjusted under 35 U.S.C. 154(b) by 0 days.

(21) Appl. No.: 10/777,932

(22) Filed: Feb. 12, 2004

(65) Prior Publication Data

US 2005/0178065 A1 Aug. 18, 2005

(51) Int. Cl.
*E01F 13/00* (2006.01)

(52) U.S. Cl. ..... 49/49; 256/73; 404/6

(58) Field of Classification Search ..... 256/73, 256/13.1, 1; 49/49, 70, 501, 9, 34; 404/6, 404/1, 10; 52/174
See application file for complete search history.

(56) References Cited

U.S. PATENT DOCUMENTS

| | | | | | |
|---|---|---|---|---|---|
| 391,526 | A | * | 10/1888 | Foran | 114/218 |
| 1,437,404 | A | | 12/1922 | Donovan | |
| 1,601,311 | A | | 9/1926 | Koski | |
| 1,711,243 | A | | 4/1929 | Neeld | |
| 2,263,649 | A | * | 11/1941 | Sawyer | 49/9 |
| 2,324,726 | A | * | 7/1943 | Sawyer | 160/327 |
| 4,152,871 | A | | 5/1979 | Kardash, Jr. | |
| 4,576,507 | A | | 3/1986 | Terio | |
| 4,628,638 | A | | 12/1986 | Elko et al. | |
| 4,759,655 | A | | 7/1988 | Gorlov | |
| 4,780,020 | A | * | 10/1988 | Terio | 404/6 |
| 4,844,653 | A | * | 7/1989 | Dickinson | 404/6 |
| 4,989,835 | A | * | 2/1991 | Hirsh | 256/13.1 |
| 5,118,056 | A | | 6/1992 | Jeanise | |
| 5,136,813 | A | * | 8/1992 | Gibbs et al. | 49/404 |
| 5,261,187 | A | | 11/1993 | Prenger | |
| 5,299,781 | A | * | 4/1994 | Barrett et al. | 256/12.5 |
| 5,395,105 | A | * | 3/1995 | Thommen, Jr. | 256/12.5 |
| 5,634,738 | A | | 6/1997 | Jackson et al. | |
| 5,740,629 | A | * | 4/1998 | Fischer et al. | 49/9 |
| 5,762,443 | A | | 6/1998 | Gelfand et al. | |
| 5,829,912 | A | | 11/1998 | Marcotullio et al. | |
| 5,987,816 | A | * | 11/1999 | Fischer et al. | 49/9 |
| 6,092,338 | A | | 7/2000 | Crowner et al. | |
| 6,382,869 | B1 | * | 5/2002 | Dickinson | 404/6 |
| 6,843,613 | B1 | * | 1/2005 | Gelfand et al. | 404/6 |

OTHER PUBLICATIONS

A collection of 3 photographs of two different gates supposedly installed in a government facility at least as early as Oct. 2002.

* cited by examiner

*Primary Examiner*—Gregory J. Strimbu
(74) *Attorney, Agent, or Firm*—Luedeka, Neely & Graham, P.C.

(57) ABSTRACT

A system for upgrading new and existing gates or barriers to provide improved crash barrier rating. This system comprises a reinforcing attachment to the gate or barrier and improved reinforced bollards with catch hooks to absorb the energy of impact from a vehicle. The reinforcing attachment is an arrangement of cable and structural members that provide for increased reinforcement by ensuring that the load is distributed on the cable to minimize the risk of breakthrough as a result of cable failure. The bollards have been improved by strengthening the catch hook attachments and adding reinforcement positioning elements to facilitate proper assembly.

15 Claims, 6 Drawing Sheets

SECURITY BARRIER REINFORCING SYSTEM

BACKGROUND

With heightened security requirements at facilities across the country and overseas, the need has become apparent for a device that can easily upgrade gates and fences to meet necessary crash barrier requirements. A simple device in use at Argonne National Laboratory since the mid-1980s provides an approach that has been improved with this invention. That device is believed to be the "novel gate barrier" determined to be in the public domain according to a letter on Argonne National Laboratory letterhead from E. Gale Pewitt, Chief Operations Officer, to Mr. David Fitzgerald at the Tennessee Innovation Center, dated Sep. 22, 1987. The "novel gate barrier" is simply a straight steel pipe with a wire rope cable through it. The cable ends are connected so that the cable forms a loop, part inside and part outside the pipe. The pipe is attached to the fence and the cable loop hangs below the pipe. A variation at another gate apparently has metal standoffs welded to the pipe and clamped to the cable to hold the cable above the pipe. The pipe is attached to the gate, and two bollards with hooks will catch the cable loop when impacted in such a way that the pipe passes through the bollards. Barrier Concepts, Inc., Crisp & Associates, and Performance Development Corporation have offered this "novel gate barrier" style barrier reinforcement for sale since the late 1980s.

The various versions of this "novel gate barrier" reinforcing system permit the full force of impact to bear as a concentrated load on one thickness of cable at the bollard catch-hook after the pipe has pushed through. Similarly, these systems do not provide protection against cutting action of the pipe ends or the standoffs on the wire rope.

In early 2003, Performance Development Corporation offered a system wherein two straight sections of pipe reinforced with cable and connected to each other were to be attached to a gate. This system was heavier and more complex in that it required additional cable fittings, additional pipe, an additional row of catch hooks on the bollards, and more precise placement of the attachments to the gate.

Although it is not known whether the "novel gate barrier" version used an I-beam to reinforce the bollards, the Barrier Concepts, Inc. and Performance Development Corporation versions did. Installation of reinforcing steel in the bollards can be inconsistent, potentially reducing the benefit of the reinforcement in resisting higher impact crashes.

The "novel gate barrier," the Barrier Concepts, Inc., and the early 2003 Performance Development Corporation bollards all used catch hooks fabricated from pipe, welded to the surface of the bollard.

Our improved Security Barrier Reinforcing System 1) provides for distribution of the loading on the cable at impact, 2) transfers critical impact loading from the cable to the pipe, 3) eliminates sharp edges that could cut the cable from long term use or impact, 4) uses an improved catch hook design that is welded both at the surface and at the opposite side of the bollard, and 5) includes a modified reinforcement technique for the bollard to facilitate installation.

While numerous gates and barriers have been developed to stop or ensnare vehicles, patented devices to modify or strengthen existing gates and barriers are uncommon. Fischer's Fortified Gate System addressed in U.S. Pat. No. 5,740,629 (issued Apr. 21, 1998) and U.S. Pat. No. 5,987,816 (issued Nov. 23, 1999) is an example of such a reinforced system. The Fischer system, however, requires anchors with a spring-loaded locking mechanism, and does not provide a passive mechanism such as trapping the bollard catch to arrest forward motion. Once installed, our Security Barrier Reinforcing System does not require operation of any active elements to perform its function.

Field of Search:

Classifications 49/9; 256/13.1; 256/73

BRIEF SUMMARY OF THE INVENTION

This invention provides an improved system to upgrade a preexisting swinging or sliding gate or other barrier section to an effective anti-ram vehicle barrier by attaching to the barrier a reinforcing structural member and cable assembly that provides more evenly distributed loading and reduced damage potential to the cable. The invention also improves the bollards to catch the attached assembly by 1) increasing the strength of the catch hook and its attachment to the bollard and 2) providing for reinforcement positioning so that the bollards may be more easily installed properly.

DETAILED DESCRIPTION OF THE INVENTION

Figure 1:
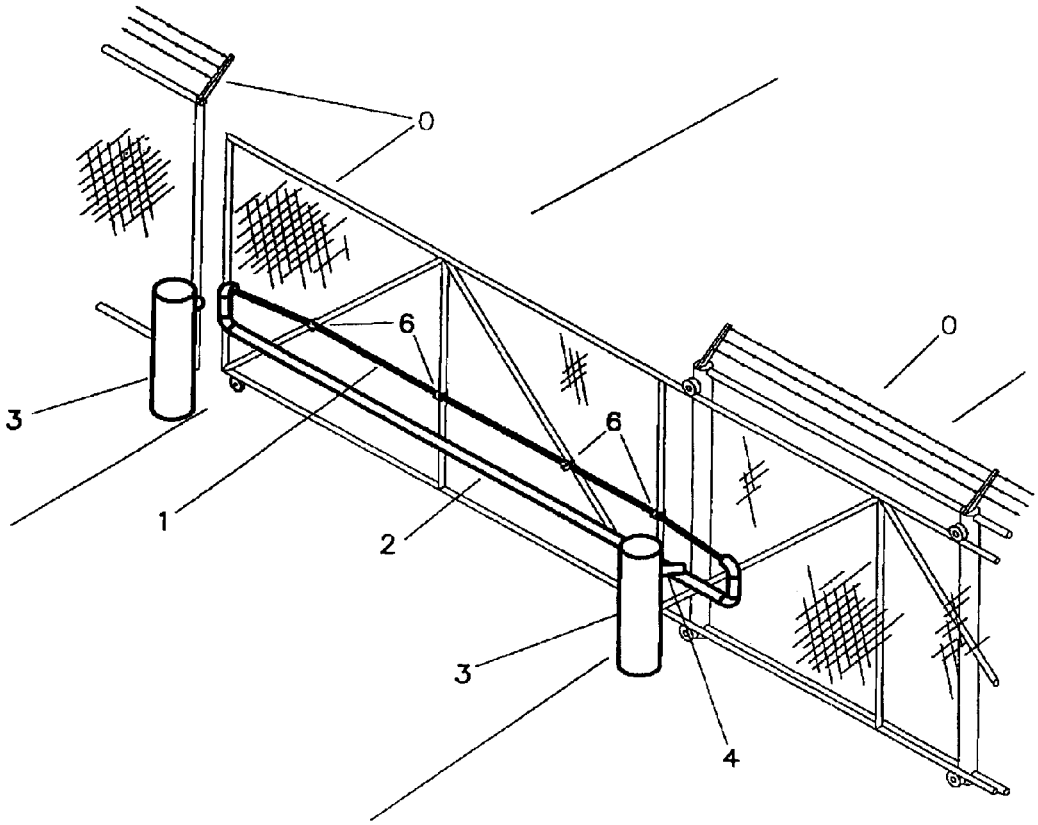
FIG. 1 is an isometric drawing showing the best mode embodiment of the cable and structural member stopping assembly and bollards as installed to reinforce an existing gate.

An overview of the preferred embodiment (or best mode) of the invention is shown in FIG. 1. This embodiment is based on a twenty foot wide drive, with an intent to stop a fifteen-thousand pound vehicle traveling at fifty miles per hour. In the preferred embodiment, the cable (1) is a 1½" multistrand steel cable, but any cable of sufficient strength to provide the required stopping force would suffice. The invention consists of an assembly of flexible cable (1) routed through a structural member (2) that has joints and ends finished so that when impacted, the force of the impact is absorbed by both the structural member and the cable, the force is distributed with regard to the cable and no surface provides a cutting action on the cable. This assembly shall be of sufficient width to span the barrier or gate section to be protected (O) and shall be attachable to an existing barrier or gate in such a way as not to impede the regular operation of said barrier or gate. Additionally, the invention consists of a minimum of two bollards (3) made of reinforced, anchored structural members on the protected side of the barrier. These bollards shall be spaced to permit passage when the barrier/gate is open, and to catch the structural member/cable assembly when the gate is closed. Said bollards shall have catch hooks (4) arranged to catch said cable/structural assembly if the barrier or gate is impacted with a force greater than the barrier or gate alone would withstand, as by a vehicle attempting to crash through the barrier or gate.

Cable (1), structural member (2), and bollards (3) shall be sized according to the anticipated threat. In the preferred embodiment, the cable is formed into a loop by joining the ends using a standard means for joining cable sufficient to maintain required strength of the cable, such as a splice or multiplicity of rope clamps. The structural member in the attachable assembly shall be formed in such a manner as to avoid sharp edges that could cut the cable. Similarly, the bollard/catch-hook arrangement shall not present any sharp edges capable of cutting any part of the structural member/cable assembly.

Figure 2:
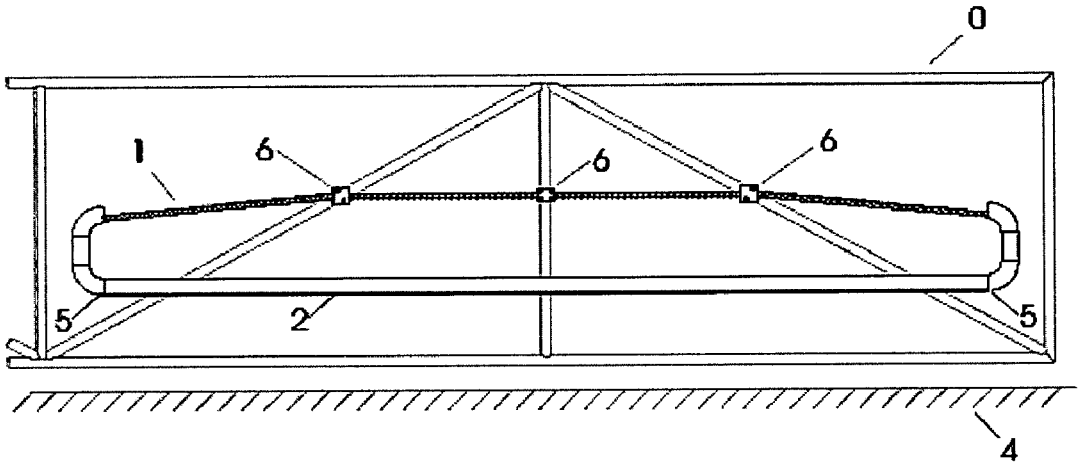
FIG. 2 shows the best mode embodiment of the stopping assembly as attached to an existing barrier.
Figure 3:
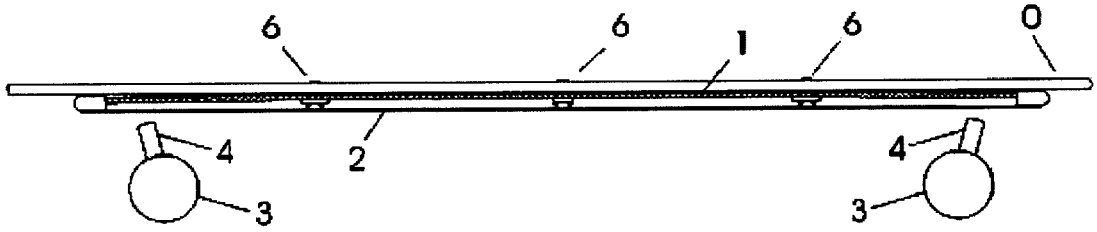
FIG. 3 shows a top view of the best mode embodiment of the stopping assembly and bollard arrangement

FIG. 2 shows the attachable stopping assembly in greater detail. The structural member (2) could be any pipe, tube, beam, or channel of sufficient strength that could be configured with smooth bends so that no sharp edge will pull against the cable when impacted. The structural member could be bent so that no interior edges are exposed, or it could be welded, with any rough edges ground smooth. In the preferred embodiment, the structural member is 4" schedule 40 or heavier steel pipe. The long straight section is a twenty-two foot section of pipe. Two ninety-degree bends with a short section of pipe between them are butt-welded to each end of the straight section of pipe. Small holes (5) are drilled in the outside low point of the elbow attached to each end of the straight pipe to provide drainage for rainwater or condensation that collects inside the pipe assembly. Once fabricated, the pipe assembly is hot dip galvanized. (The drain holes and coating are provided to reduce corrosion. The drain holes also reduce weight by preventing water build-up in the pipe.)

The cable (1) is routed through the pipe assembly (2), pulled tight, and the ends joined with a swaged fitting. (Any joining method that maintains the tensile strength of the cable is suitable. For instance, multiple rope clamps have been used to join the ends on occasion.) Once joined, the loop is pulled around so that the joint is inside the pipe assembly. The assembly provides a smooth interior surface and is arranged so that the cable enters the two open ends of the pipe with no cutting force against it as shown in FIG. 2.

The cable and pipe assembly are then attached to the gate or barrier (0). In the preferred mode, this attachment is by clamping the cable with U-bolt brackets (6) to braces on the gate, but the attachment could be by any means to the bracing, fencing, or other barrier material, so long as it is sufficiently sturdy to support the assembly. If needed, braces could be added to the gate or barrier to support the cable/pipe assembly. Figure three shows a top view of the stopping assembly attached to the gate or barrier adjacent to the bollards.

Figure 4:
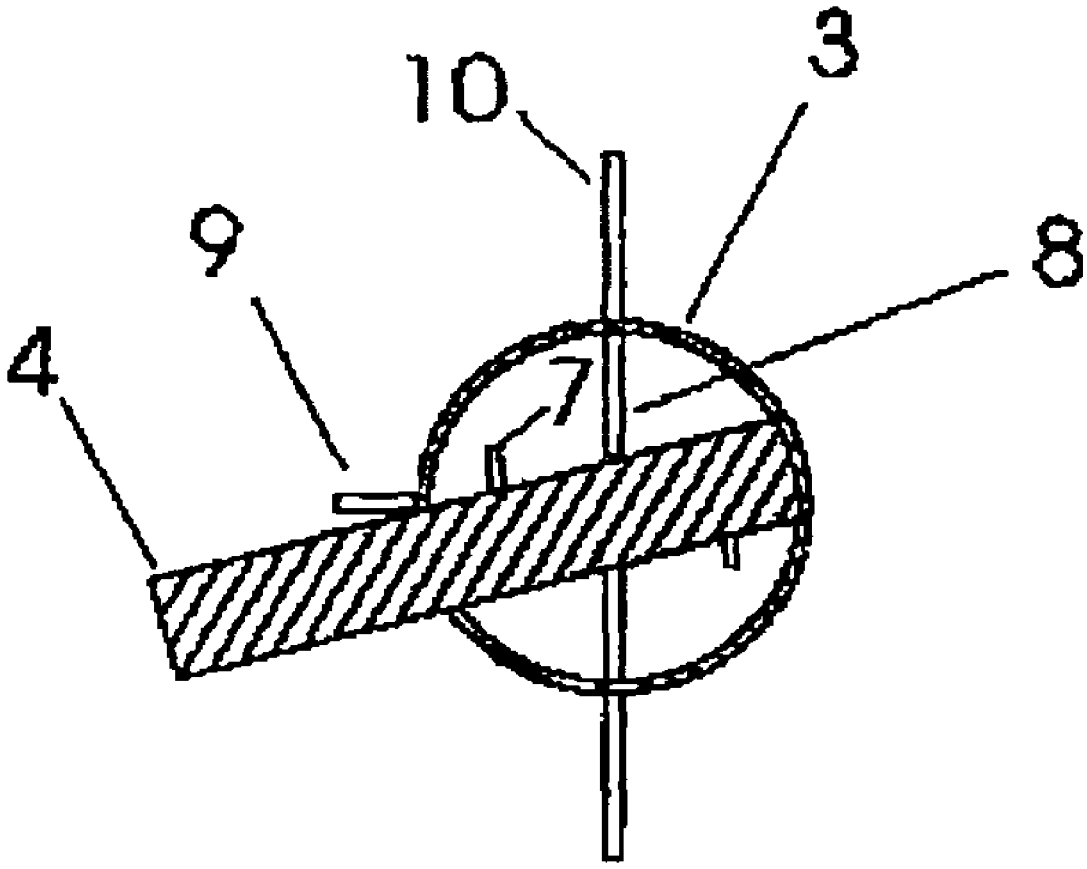
FIG. 4 shows a top view of the best mode embodiment, providing a detail of the anchored and reinforced vertical members (bollards) with catch hook.
Figure 4A:
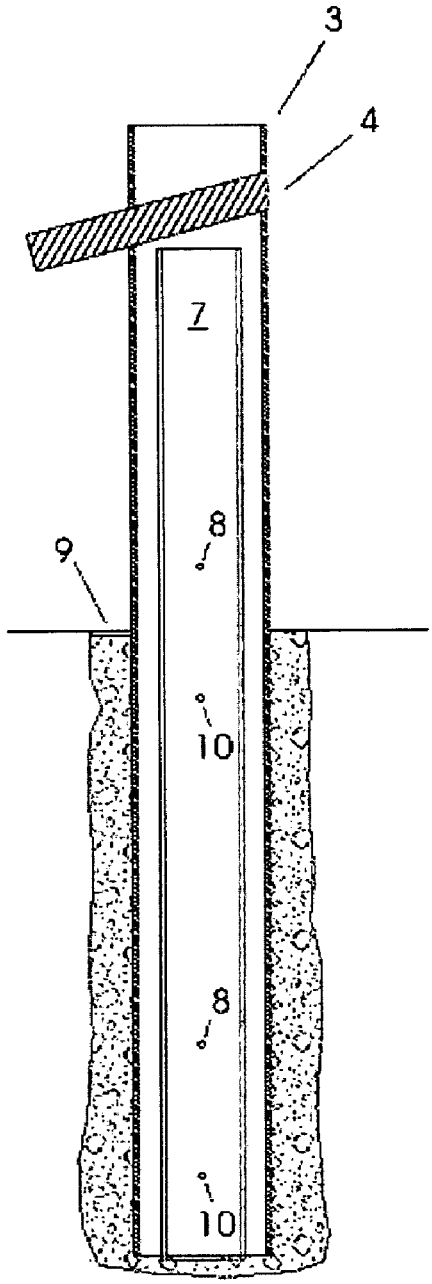
FIG. 4*a* shows a side cutaway view of the best mode embodiment, providing a detail of the anchored and reinforced vertical members (bollards) with catch hook.
Figure 4B:
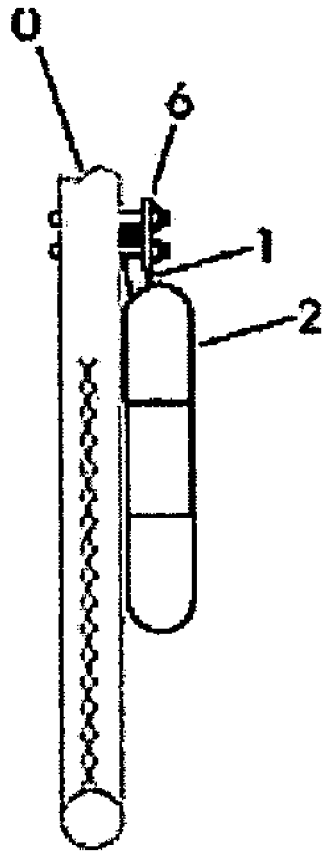
FIG. 4*b* shows a side view of the best mode embodiment providing a detail of the cable and structural member stopping assembly.

FIG. 4 provides a detail view of the bollard. In the preferred mode of the invention, the bollards (3) are made up of a shell of 8' long schedule 40 or heavier 12" steel pipe with an 8"×23# reinforcing I-beam (7) inside along the centerline for approximately the bottom seven feet. The length of the bollard should be adjusted as appropriate for the application. Short pieces of rebar (8) are welded to the I-beam to center it within the pipe. A hole is cut in one side of the pipe for the cable horn catch, which is made of 3½" round stock and welded to the pipe both where it penetrates the pipe and where it meets the opposite wall of the pipe at a 15° angle downward and 15° outward from the I-beam (7) web. The pipe may also have a hole cut in the opposite pipe wall, to facilitate welding the end of the catch hook from the outside. Excess round stock or weld material on the side opposite the hook is cut off and ground smooth as needed prior to galvanizing or painting. A tab (9) is attached to the pipe, welded in the preferred embodiment, at approximately ground level to indicate the orientation of the bollard. This tab is located to mark the face of the pipe that is to be installed facing the plane of the gate.

A 1" hole is drilled through each side of the bollard pipe, perpendicular to the desired orientation of the I-beam web, approximately one foot below ground level, and approximately one foot above the bottom. In the preferred mode, the pipe/hook assembly is then hot-dip galvanized or coated to reduce corrosion.

Holes are drilled through the web of the I-beam to match the 1" holes in the pipe. Short lengths of rebar are tack-welded onto the I-beam web to keep the I-beam centered in the pipe. The I-beam is then inserted into the pipe and suspended in position with 1" rods (or rebar) (10) through the holes. The bollards are installed vertically, embedded for 5' of their length below ground level in a concrete base. The installed bollards are filled with concrete to add to their mass and rigidity. The bollards should be close enough to the assembly attached to the gate or barrier to ensure that the assembly will catch on the hooks when impacted. In the preferred mode arrangement, this distance was set at 2"–3". The base size should be adjusted for local conditions, to ensure sufficient anchoring to absorb the anticipated impact. In some conditions, rather than embedding the post in a concrete anchor, it might be desirable to attach vanes to the pipe and set the bollard in tamped earth without the concrete or to use some other anchoring technique. It is conceivable that one might want to build the bollard on a baseplate and reinforce the bollard with gussets for a more temporary arrangement.

What is claimed is:

1. A barrier reinforcement comprising:

at least one stopping assembly attachable to a barrier to be reinforced, the stopping assembly comprising a flexible cable member at least partially sheathed within an elongated structural member having substantially hook-shaped curved end portions for distributing loading and limiting cutting forces on the flexible cable member when tension is applied to the flexible cable member; and at least two anchored and reinforced upright members on a protected side of the stopping assembly, each upright member having at least one passive engagement device to catch the at least one stopping assembly when the barrier is impacted.

2. The barrier reinforcement of claim 1 wherein the flexible cable member forms a substantially continuous loop.

3. The barrier reinforcement of claim 1 wherein the upright members comprise reinforcing members suspended within the upright members and centering mechanisms to maintain the barrier reinforcement in the desired location during installation.

4. The barrier reinforcement of claim 1 wherein the passive engagement devices are attached to the upright members on a side of the upright members to be impacted by the stopping assembly and a side of the upright members approximately opposite the side to be impacted.

5. The barrier reinforcement of claim 1, wherein the passive engagement devices comprise horns extending from the upright members such that the stopping assembly is engaged substantially at junctions of the horns and upright members when the barrier is impacted.

6. The barrier reinforcement of claim 5, wherein the horns extend from the upright members at an angle about 15 degrees downward from a horizontal plane and wherein the horns are splayed outward with respect to each other at an angle about 15 degrees from a vertical plane perpendicular to the barrier.

7. The barrier reinforcement of claim 1, wherein the elongated structural member is tubular.

8. A barrier reinforcement assembly comprising:

a substantially continuous cable that is attachable to a barrier and that is at least partially enclosed within a sheath; and at least two spaced apart bollards, wherein each bollard comprises a static elongate horn extending therefrom for engaging the sheathed cable when the barrier is impacted, wherein the static elongate horns extend from the bollards at an angle about 15 degrees downward from a horizontal plane and are splayed outwardly with respect to each other at an angle about 15 degrees from a vertical plane perpendicular to the barrier so that the horns more effectively engage the sheathed cable.

9. The barrier reinforcement assembly of claim 8, wherein the sheath comprises curved end portions.

10. The barrier reinforcement assembly of claim 9, wherein the curved end portions of the sheath are substantially hook shaped.

11. The barrier reinforcement assembly of claim 8, wherein the cable is a substantially continuous loop.

12. The barrier reinforcement assembly of claim 8, wherein the bollards include internal reinforcement members encased in concrete.

13. The barrier reinforcement assembly of claim 8, wherein the static elongate horns are each attached to a respective one of the bollards in at least two separate locations to improve the strength of the barrier reinforcement assembly.

14. A barrier reinforcement assembly comprising:

a stopping assembly attachable to a barrier and including a substantially continuous cable at least partially sheathed within at least one tubular member having substantially hook shaped curved end portions; and at least two spaced apart reinforced bollards for disposition closely adjacent the curved end portions of the tubular member when the barrier is in a closed position, wherein each bollard comprises an elongate horn for engaging the stopping assembly upon an impact of the barrier, wherein the horns are splayed outwardly with respect to each other to more effectively engage the stopping assembly.

15. The barrier reinforcement assembly of claim 14, wherein the horns extend from the bollards at an angle about 15 degrees downward from a horizontal plane and are splayed outwardly with respect to each other at an angle about 15 degrees from a vertical plane perpendicular to the barrier.

* * * * *